US006199028B1

(12) United States Patent
Repperger et al.

(10) Patent No.: US 6,199,028 B1
(45) Date of Patent: Mar. 6, 2001

(54) DETECTOR FOR HUMAN LOSS OF TRACKING CONTROL

(75) Inventors: Daniel W. Repperger, Dayton; Michael W. Haas, Beaver Creek, both of OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 09/244,828

(22) Filed: Feb. 4, 1999

(51) Int. Cl.[7] ..... G06F 17/00; F41G 7/00

(52) U.S. Cl. ..... 702/189; 702/94; 701/3; 701/122; 244/3.1; 244/221

(58) Field of Search ..... 702/94, 95, 150, 702/189; 701/3, 116, 120, 122, 213–214; 244/3.1, 3.11, 195, 220, 221; 700/28, 43, 45, 80

(56) References Cited

U.S. PATENT DOCUMENTS

| | | | | |
|---|---|---|---|---|
| 3,832,065 | | 8/1974 | Sullivan et al. | 356/210 |
| 4,092,716 | * | 5/1978 | Berg et al. | 701/3 |
| 4,269,512 | | 5/1981 | Nosler | 356/375 |
| 4,477,043 | * | 10/1984 | Repperger | 244/223 |
| 4,536,866 | | 8/1985 | Jerome et al. | 369/112 |
| 4,773,055 | | 9/1988 | Gijzen et al. | 369/45 |
| 5,016,177 | * | 5/1991 | Lambregts | 244/181 |
| 5,062,594 | * | 11/1991 | Repperger | 701/3 |
| 5,101,472 | * | 3/1992 | Repperger | 700/261 |
| 5,353,226 | | 10/1994 | Repperger et al. | 364/433 |
| 5,629,848 | | 5/1997 | Repperger et al. | 364/424.06 |
| 5,651,512 | * | 7/1997 | Sand et al. | 244/3.11 |

* cited by examiner

*Primary Examiner*—Marc S. Hoff
*Assistant Examiner*—Bryan Bui
(74) *Attorney, Agent, or Firm*—Gina S. Tollefson; Gerald B. Hollins; Thomas L. Kundert

(57) ABSTRACT

A device is described which incorporates three components: a tracking error estimator, a detector, and a red light indicator to alert a pilot to the potential loss of tracking control. The tracking error estimator uses the difference between the target and the desired response of the tracking aircraft to estimate the divergence from a desired tracking path. This difference is acquired by such systems as, for example, the Global Positioning System (GPS) and radar. The tracking error and its derivatives are then converted into three different metrics. The metrics represent percentage points when the tracking error and its derivatives are in an unstable or stable portion of its phase plane. Depending upon whether these metrics and/or their combinations are above a particular threshold, the detector and indicator will alert the pilot or operator whether or not corrective action needs to be taken. The threshold is determined by a predetermined logic tree. This system has applicability in a variety of tracking scenarios involving pilots or simulator system operators. Pilots, when they fly tactical aircraft, are preoccupied in a number of different tracking tasks which can be assisted by the invention described herein.

19 Claims, 15 Drawing Sheets

Closed Loop Tracking Error - Controllable Situation

Closed Loop Tracking Error - Uncontrollable Situation

Controllable Situation - Plot of e-dot versus e

Controllable Situation - Plot of e-dot double dot versus e-hat dot

Controllable Situation - Plot of e-dot triple dot versus e-hat double dot

Uncontrollable Situation - Plot of e-dot versus e

Uncontrollable Situation - Plot of e-hat double dot versus e-hat dot

Uncontrollable Situation - Plot of e-hat triple dot versus e-hat double dot

DETECTOR FOR HUMAN LOSS OF TRACKING CONTROL

RIGHTS OF THE GOVERNMENT

The invention described herein may be manufactured, used, sold, imported, and/or licensed by or for the Government of the United States of America without the payment of any royalties thereon.

FIELD OF THE INVENTION

This invention relates to the field of aircraft pilot assistance systems and more particularly to systems that detect tracking errors.

BACKGROUND OF THE INVENTION

Devices that help pilots fly aircraft in unusual environments and circumstances are necessary as the performance characteristics of aircraft steadily increase. An example of one such device is described in U.S. Pat. No. 5,353,226, issued to D. W. Repperger on May 7, 1996 and entitled, "Coriolis Indicator For Situational Awareness." The device described in this U.S. Patent uses measurements of angular rates (aircraft body axis rates) and an indicator to detect the existence of Coriolis accelerations which may not be immediately obvious to a pilot. The presence of Coriolis accelerations affects a pilot's perception of aircraft attitude and spatial orientation, thus potentially affecting the safety of the pilot.

Another example of a pilot assistance device is described in U.S. Pat. No. 5,629,848, issued to Repperger et al on May 13, 1997 and entitled, "Spatial Disorientation Detector." This detector senses important acceleration fields that are known to produce spatial disorientation to a pilot. This detector utilizes implicit models of the human vestibular system and a Kalman filter estimator to examine when adverse environmental influences may exist, even though these influences may not be readily detected by the pilot.

Examples of other pilot assistance devices and/or methods are found in the following articles: R. F. Stengel, "Toward Intelligent Flight Control," IEEE Transactions on Systems, Man, and Cybernetics, vol. 23, No. 6, November/December 1993, pp. 1699–1717; T. B. Sheridan and W. R. Ferrell, "Man-Machine Systems: Information, Control, and Decision Models of Human Performance," The MIT Press, Cambridge, Mass., 1974; R. A. Hess, "Effects of Time Delays on Systems Subject To Manual Control," J. Guidance, July–August, 1984, pp. 416–421; and R. A. Hess, "Technique For Predicting Longitudinal Pilot-Induced Oscillations," J. Guidance, vol. 14, no. 1, 1990, pp. 198–204.

There still exists a need in these arts to not only notify the pilot of adverse conditions, but also to assist the pilot in tracking tasks. These tasks include pursuit or chase of another aircraft wherein the minimization of the error between position and orientation of the two aircraft is critical, following a specified flight trajectory or flight path, or following a specified terrain or runway. The present invention addresses this need.

SUMMARY OF THE INVENTION

Accordingly, one general object of the present invention is to provide a method and device that will assist a pilot in tracking various objects, and/or flight path, and/or terrain when flying. Another object of the present invention is to aid pilot training when over-control, and associated pilot-induced oscillation in pitch and/or roll is present. A third object of this invention is to aid operators of uninhabited vehicles when flying a specified flight path using a video feed from the vehicle to the ground-based control station.

Generally, the present invention is a device and method which includes a tracking error estimator, a detector and an indicator to alert the pilot to the potential loss of tracking control. The tracking error estimator uses the difference between the target and the desired response of the tracking aircraft to estimate the divergence from a desired tracking path. This difference is acquired by such systems as the Global Positioning System (GPS), radar, data link, video source, etc. The tracking error and its derivatives are then converted into 3 different metrics. The metrics represent percentage points when the tracking error and its derivatives are in an unstable or stable portion of its phase plane. Depending on whether these metrics and/or their combinations are above a particular threshold, the detector and indicator will alert the pilot or operator whether or not corrective action needs to be taken. The threshold is determined by a predetermined logic tree.

The present invention anticipates a different type of detection system than those previously disclosed. The present invention monitors and identifies instabilities that may occur in the tracking of either moving or stationary targets. The purpose of the present invention is to provide a pilot in an aircraft, or an operator of a remote aircraft simulation system, an improved awareness of the possibility that the tracking error is about to diverge. In one embodiment of the invention, a red light indicator will illuminate, indicating that sudden changes have to be made because the tracking error will suddenly get larger and that loss of control is possible. Such a device provides an alerting mechanism to the pilot or operator of a ground-based tracking system of the imminent loss of control of the tracking task. The pilot or person involved in the tracking task may wish to modify the aircraft's characteristics or make other adaptive changes in order to improve the performance of the mission at hand. The apparatus described herein will also be helpful in predicting the incidence of a pilot-induced oscillation (PIO). PIO commonly occurs when pilots test new aircraft, and represents one of the first indications of loss of control of the aircraft. Finally, another possible application of the present invention may be to help establish a decision rule for an automated system to take over control of an aircraft when some undesirable event is about to produce a large tracking error. This device can also be used to predict a sudden change in error when landing an aircraft or when tasked with the mission of following terrain or other targets fixed in space.

BRIEF DESCRIPTION OF THE DRAWINGS

These and other features of the invention will be understood in light of the ensuing detailed description of the invention and the attached figures, wherein.

DETAILED DESCRIPTION OF THE INVENTION

Figure 1:
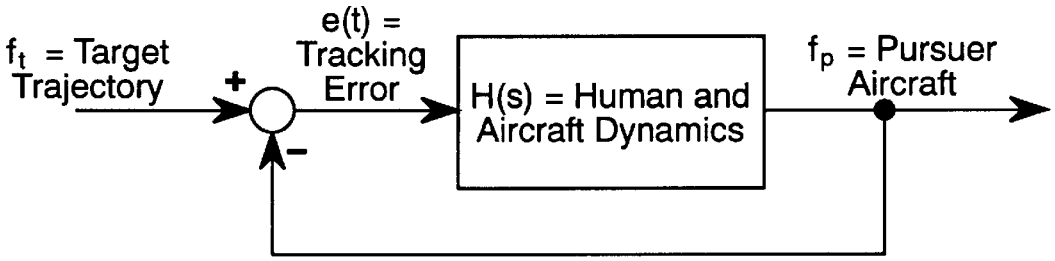
FIG. 1 is a generic diagram of the method according to the present invention.

FIG. 1 illustrates a generic device and method according to the present invention which is useful in detecting tracking error instability. The variable $f_t$ shown in FIG. 1 represents the target trajectory of the tracked object which could be another aircraft (moving target), or a stationary target such as a landing path, a terrain following scenario, or any other non-moving target. The output of the human-machine system is $f_p$ which represents the tracking aircraft's output, i.e., its position and orientation, in response to $f_t$. The term human-machine system, as used throughout the remainder of this description, means the interactive system of a human being flying or operating an aircraft. A transfer function H(s) is used in FIG. 1 to characterize the combination of pilot-aircraft dynamics. The tracking error e(t) represents the difference between the target and the desired response of the tracking aircraft, which is ideally $f_p=f_t$, but the more practical case is ($f_p \neq f_t$). A nonzero error, such as ($e(t)=f_t-f_p$), is more likely to result.

It is common knowledge that in modem aircraft systems both the measurements of $f_p$ and $f_t$ are available. They can be calculated from systems such as Global Positioning System (GPS), radar, the Airborne Warning and Control System (AWACS) (another aircraft to pinpoint objects in the combat arena), or from various sensor-laden satellites. In addition, $f_t$ can be a specified flight trajectory, such as a navigation route or a landing approach. Thus, knowledge of $f_p$, $f_t$, and e(t) are available, on-line, in real time.

In accordance with the present invention, a tracking error estimator provides a high degree of accuracy in estimating the tracking error. With this tracking error estimator, a detector and indicator are fashioned to alert a pilot (or tracker in a ground based system) to potential problems. For example, if it is determined that a divergence of the tracking error is about to occur, an automated system could take control of the aircraft from the pilot and fly safely when the pilot may not be capable.

To specifically understand how error divergence can be predicted, two methods of analyzing this process will now be described. The first method deals with "phase plane" plots of the closed-loop error signal e(t). Three different types of phase plane plots are utilized and the instability information can be culled from these plots using a relationship derived from a Euler's approximation of the closed-loop pilot-aircraft dynamics. Euler's method is borrowed from studies involving numerical approximation theory. The second method studies the magnitude and phase characteristics of the closed-loop tracking error at the brink of instability (termed a "pilot-induced oscillation" or PIO). The second technique will be described to develop concurrence with the first method (phase plane approach) and is useful in explaining how to detect a pilot-induced oscillation. Both of these methods are then used in accordance with the present invention.

Method 1—Phase Plane Analysis Techniques

Figure 2:
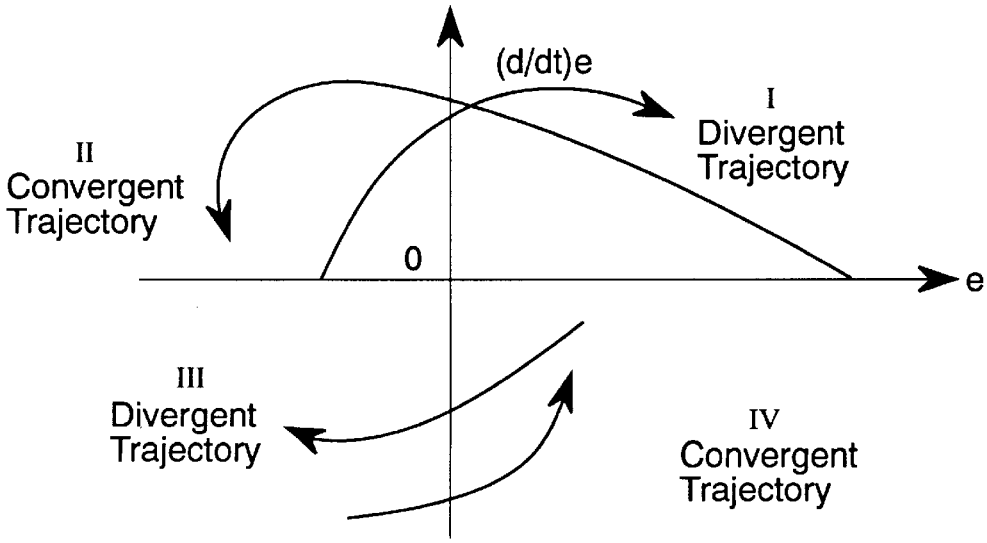
FIG. 2 is a diagram of a phase plane showing four examples of various trajectories within the phase plane.
Figure 8A:
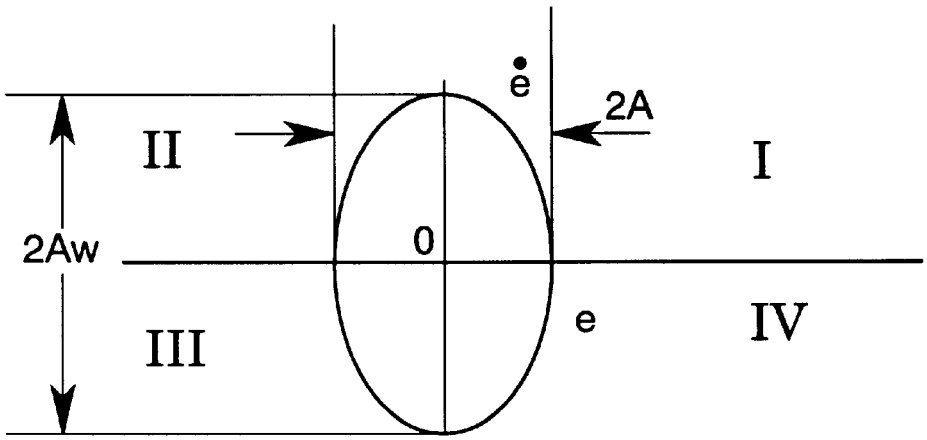
FIGS. 8*a*, 8*b*, and 8*c* illustrate a synthesized phase plane plot describing a sinusoidal e(t) signal (during a PIO) within the context of FIG. 1.
Figure 8B:
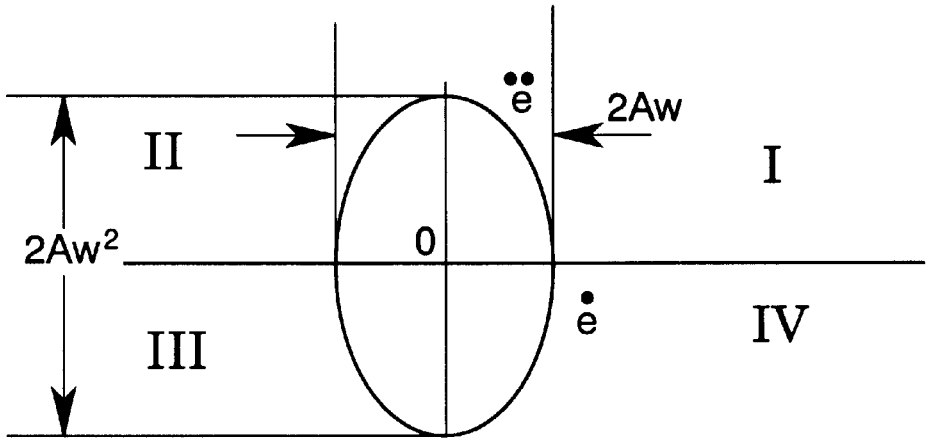
Figure 8C:
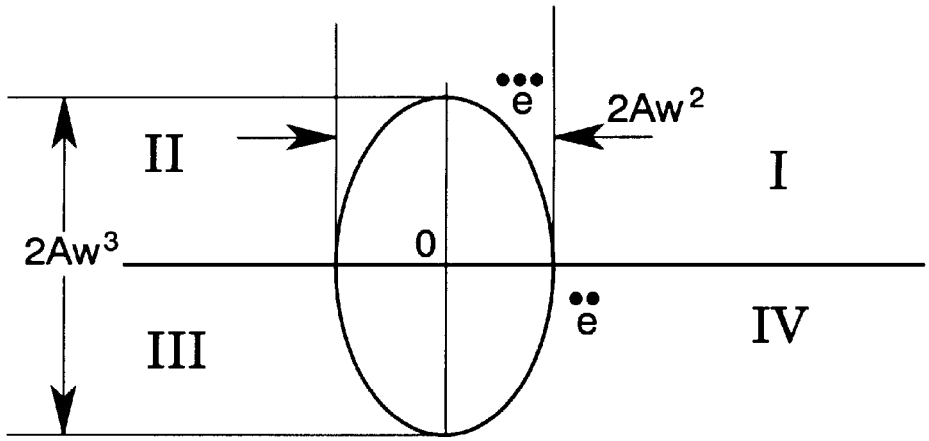

In FIG. 2, a diagram of a "Phase Plane" is plotted and FIG. 8 illustrates a synthesized phase plane plot. The independent variable (horizontal axis) is the variable e(t) or tracking error. The dependent variable (vertical axis) is the time derivative or (d/dt)e(t) quantity. The term "phase plane" arose from early studies in electrical engineering when a plot of a sine wave versus a cosine wave would yield a circle or the elliptical diagrams shown in FIG. 8*a*. The phase angle between these two signals could be directly read off the figure as plotted and, hence, it provided a framework to obtain a phase angle between two different time signals. Thus, the term "phase plane" was developed. To extrapolate this concept further, FIG. 8*b* illustrates an alternative phase plane plot of $(d^2e)/(dt^2)$ versus (de)/(dt). Generalizing this concept even further, FIG. 8*c* depicts a plot of $(d^3e)/(dt^3)$ versus $(d^2e)/(dt^2)$. It is necessary to utilize all of the FIGS. 8*a*–8*c* to explain the concept of instability because they incorporate both the magnitude and sign of the error signal (involving its respective derivatives). To better understand the types of trajectories that appear in FIGS. 2, 3 and 4, the relationship between the commonly used Euler's law in numerical integration and the classification of the types of trajectories that can occur in FIGS. 2, 3 and 4 must be explained.

Figure 3:
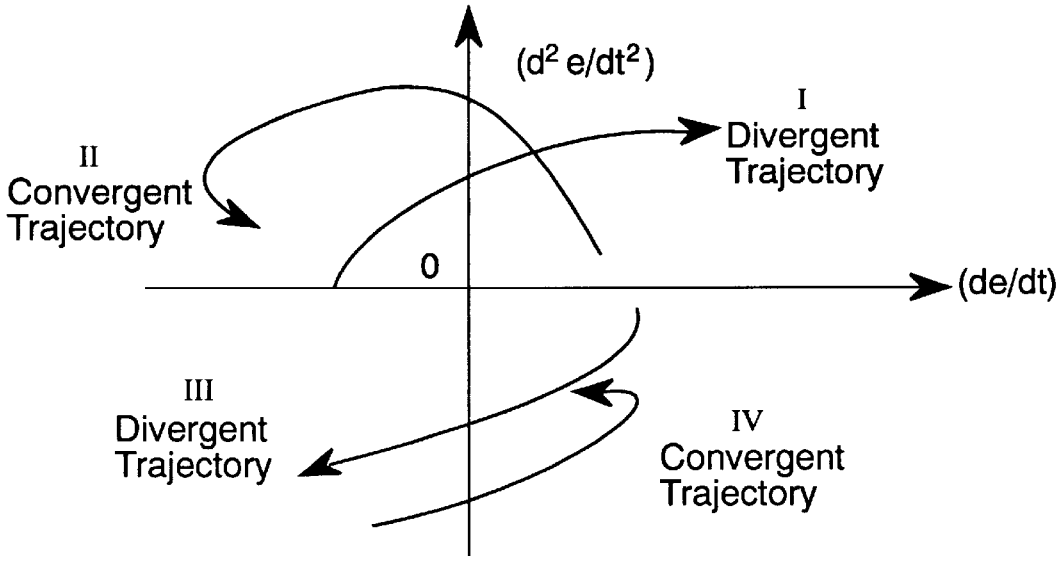
FIG. 3 illustrates an alternative phase plane plot of $(d^2e)/(dt^2)$ versus $(de)/(dt)$.
Figure 4:
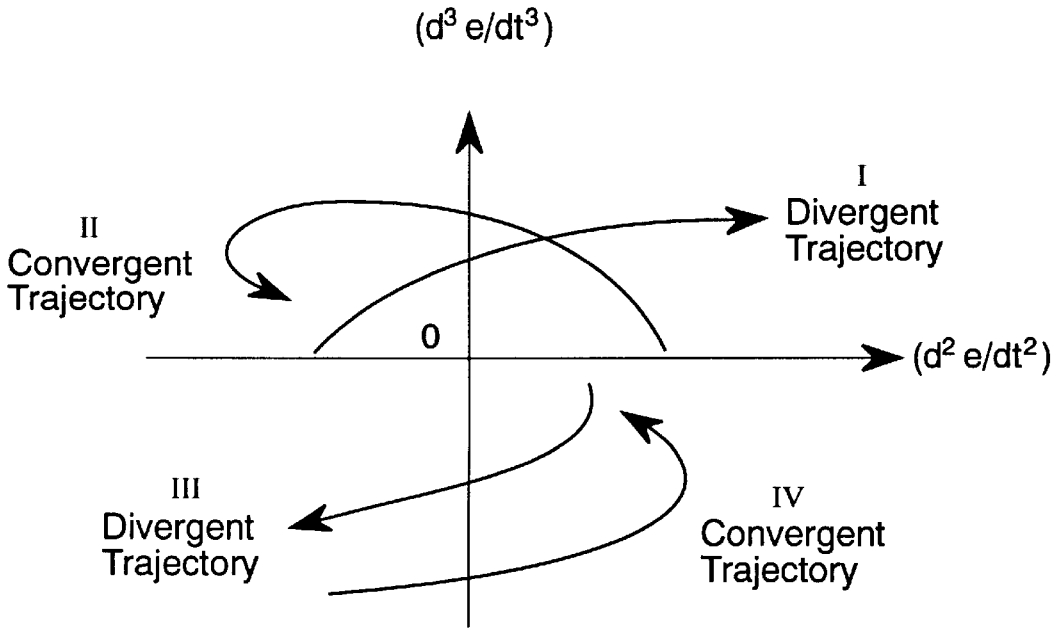
FIG. 4 depicts a plot of $(d^3e)/(dt^3)$ versus $(d^2e)/(dt^2)$.

Euler's Law and its Relationship to FIGS. 2, 3 and 4

In studies on numerical integration, $e_{t+\Delta t}$ represents a data sample of the closed-loop error signal at the time sample t+Δt and $e_t$ represents this quantity at time t. Euler's law taken to a first order approximation yields:

$$e_{t+\Delta t}=e_t+(de_t/dt)(\Delta t) \quad (1)$$

which can be considered as a first order Taylor's series expansion of the error signal about a nominal trajectory.

Equation (1) used in conjunction with the response trajectories of the different quadrants of the phase plane diagrams in FIGS. 2, 3 and 4 can classify unstable and stable types of tracking behavior in a very simple manner. These response trajectories can be broken into two major divisions: (1) stable responses, which occur in Quadrants II and IV and (2) unstable responses, which occur in Quadrants I and III.

In FIGS. 2, 3, 4, each of the phase planes is divided into four quadrants as indicated. It will be shown that trajectories moving into Quadrants II and IV of FIGS. 2, 3, and 4 always lead to stable responses and trajectories moving into Quadrants I and III always lead to unstable responses.

Stable Responses (Trajectories That Move Into Quadrants II and IV):

Using FIG. 2 and equation (1), consider first a trajectory that enters Quadrant II.

Quadrant II:

In Quadrant II, $e_t<0$, and $(d/dt)\,e_t>0$. However, it is known from Euler's law that: $e_{t+\Delta t}=e_t+(de_t/dt)\Delta t$, and since $\Delta t>0$, it follows that $\cdot e_{t+\Delta t}\cdot<\cdot e_t\cdot$ where, $\cdot.\cdot$ indicates the length or distance measure of a vector (the square root of the sum of the squares of its components). Thus, the magnitude of the error at time step t+Δt is less than the magnitude of the error at time step t. Hence, the magnitude of the error signal is decreasing in time and the tracking error is under control or converging. This same reasoning applies if the trajectory enters Quadrant IV of FIG. 2.

Quadrant IV

In Quadrant IV, $e_t>0$ and (d/dt) $e_t<0$. Again, using the Euler's relationship $e_{t+\Delta t}=e_t+(de_t/dt)\Delta t$, and of course, since $\Delta t>0$, then, again $\cdot e_{t+\Delta t}\cdot<\cdot e_t\cdot$ and the magnitude of the error signal is decreasing. This is a manifestation of stable tracking behavior. The alternative to this type of interaction occurs for trajectories entering Quadrants I and III.

Unstable Responses (Trajectories That Move Into Quadrants I and III)

The same reasoning is repeated for trajectories that enter Quadrant I in FIG. 2.

Quadrant I

Here, $e_t>0$ and (d/dt) $e_t>0$. Again, invoking the Euler's relationship $e_{t+\Delta t}=e_t+(de_t/dt)\Delta t$ with $\Delta t>0$, it follows that in this case, $\cdot e_{t+\Delta t}\cdot>\cdot e_t\cdot$, and error trajectory is diverging and can only get worse. This same effect is noticed for trajectories that enter Quadrant III of FIG. 2.

Quadrant III

In this quadrant, $e<0$ and (d/dt) $e<0$. Again, using $e_{t+\Delta t}=e_t+(de_t/dt)\Delta t$ with $\Delta t>0$, it follows that in this case that $\cdot e_{t+\Delta t}\cdot>\cdot e_t\cdot$, and the error trajectory is diverging in a negative sense. These results also apply to the higher order derivative phase planes in FIGS. 3 and 4 and the same reasoning is used to extrapolate this concept to the next two figures.

Extrapolation of These Results To FIG. 3

To apply this concept to a higher order phase plane, equation (1) can be rewritten in the form of higher derivative quantities as follows:

$$(d/dt)e_{t+\Delta t}=(d/dt)e_t+(d^2e_t/dt^2)\Delta t \quad (2)$$

Equation (2) is now used in lieu of equation (1) and the trajectories that enter Quadrants I and III in FIG. (3) lead to divergence behavior and trajectories that enter Quadrants II and IV in FIG. 3 lead to stable behavior. These results also extend to FIG. 4.

Extrapolation of Results To FIG. 4

To apply this concept to a further, higher-order phase plane, equation (2) can be rewritten in the form of higher derivative quantities as follows:

$$(d^2/dt^2)e_{t+\Delta t}=(d^2/dt^2)e_t+(d^3e_t/dt^3)\Delta t \quad (3)$$

Equation (3) is now used in lieu of equation (2) and similarly, the trajectories that enter Quadrants I and III in FIG. 4 lead to divergent behavior and the trajectories that enter Quadrants II and IV lead to stable behavior. This detection method according to the present invention has been validated experimentally with data from a tracking experiment, as will be explained in more detail further in this detailed description.

Estimator Element as a Method

According to the present invention, the estimator element can be fashioned as a method embodied in software or hardware. The measurement of the signal e(t) is used as stated above and its three derivatives are estimated using a processor through numerical filtering techniques, described below.

First, let a variable e be defined which will be a low pass filtered estimate of e based on available data. This yields a transfer function:

$$e/e=(1)/(1+s/\alpha)^3 \quad (4)$$

where e is an estimate of e(t), and e(t) is the measured time series (error signal), s is the Laplace transform variable, and a is the low pass filter breakpoint. Equation (4) can be rewritten as:

$$e/e=(\alpha^3)/(s^3+3\alpha s^2+3\alpha^2 s+\alpha^3) \quad (5)$$

Under steady state conditions in the time domain, equation (5) can be further expressed as:

$$(d^3e/dt^3)+3\alpha(d^2e/dt^2)+3\alpha^2(de/dt)+\alpha^3e=\alpha^3e \quad (6)$$

To assist in the estimation of e and its higher derivatives, state variables ($x_1$, $x_2$, and $x_3$) are mathematically defined as:

$$x_1:=e \quad (7)$$

$$x_2:=(d/dt)e \quad (8)$$

$$x_3:=(d^2/dt^2)e \quad (9)$$

with resulting state equations:

$$(d/dt)x_1=x_2=(d/dt)e \quad (10)$$

$$(d/dt)x_2=x_3=(d^2/dt^2)e \quad (11)$$

$$(d/dt)x_3=-3\alpha x_3-3\alpha^2x_2-\alpha^3x_1+\alpha^3e \quad (12)$$

or $$(d/dt)x_3=-3\alpha(d^2e/dt^2)-3\alpha^2(de/dt)-\alpha^3(e)+\alpha^3e \quad (13)$$

To integrate equations (10), (11), and (12), a first order Euler approximation is used on these state variables as follows:

$$x_{it+\Delta t}\approx x_{it}+(d/dt)x_{it}\Delta t \quad (14)$$

where $x_{it}$ represents the state component xi at time sample t (i=1,2,3). The initial conditions on the state variables of this filter are given by:

$$x_1(t_0)=e(t_0)=e(t_0) \quad (15)$$

$$x_2(t_0)=(d/dt)e(t_0)\approx(e(t_1)-e(t_0))/\Delta t \quad (16)$$

$$x_3(t_0)=(d^2/dt^2)e(t_0)\approx[(de(t_1)/dt)-(de(t_0)/dt)]/\Delta t\approx[e(t_2)-2e(t_1)+e(t_0)]/(\Delta t)^2 \quad (17)$$

Thus, the state variables $x_1$, $x_2$, and $x_3$ represent low pass filtered estimates of e(t), (d/dt)e(t), and $(d^2/dt^2)e(t)$, respectively. They are available on-line in real time once e(t) is calculated using the data available from system such as GPS. These state variables can then be used to detect whether the tracking error is diverging or not. Given the above disclosure, one skilled in the art could derive any number of means of implementing such an method of estimating the tracking error.

Estimator Element as an Apparatus

Figure 5:
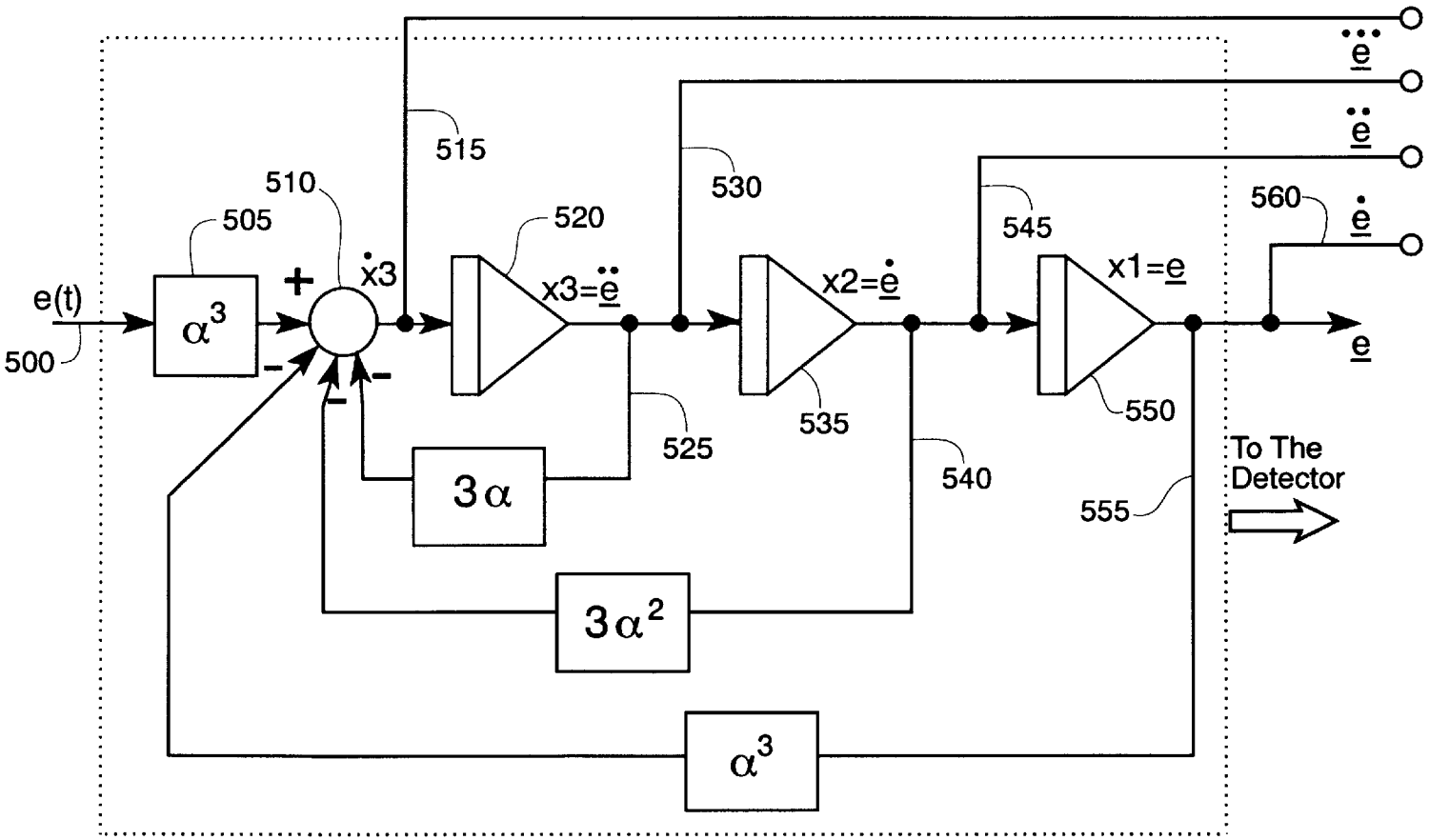
FIG. 5 illustrates one embodiment of an estimator according to the present invention.

The above-described method can also be implemented as an apparatus, i.e., hardwired into circuitry. FIG. 5 illustrates the present invention using the low pass filtering algorithm described in the previous section. As shown in FIG. 5, the state variables are outputs 530, 545, and 560 of the integrators 520, 535, and 550.

In operation, the time series (measured) e(t) enters as an input 500 at the left side of the diagram (the box enclosed inside the dotted lines in this figure). The estimated variables e(t) 560, (d/dt)e(t) 545, $(d^2/dt^2)e(t)$ 530 and $(d^3/dt^3)e(t)$ 515 leave the dotted line box on the right side of this diagram which drives the next stage of this system, the detector. The circuitry within the dotted line box acts as a low pass filter and an estimator. This circuitry is comprised of a summer 510 and integrators 520, 535, 550 which are fed back to the summer 510. The value of the signal fed back to the summer is 525 ($3\alpha$) from integrator 520, 540 ($3\alpha^2$) from integrator 535, and 555 ($\alpha^3$) from integrator 550. The value of a is the bandwidth of the low pass filter (the combination of the integrators) which can be adjusted depending on the characteristics of the incoming signal 500, e(t). Typically in laboratory applications, $\alpha$=5 radians/second or lower is quite appropriate for human tracking signals. Using the apparatus shown in FIG. 5 necessarily creates a causality between what is measured and what is estimated. As those skilled in the art will appreciate, equations (10) and (11) can be verified using this hardware implementation. Further, equations (12)–(13) are satisfied, at the summer 510 in FIG. 5, by:

$$(d/dt)x_3=-3\alpha(d^2e/dt^2)-3\alpha^2(de/dt)-\alpha^3e+\alpha^3e \quad (18)$$

Figure 6A:
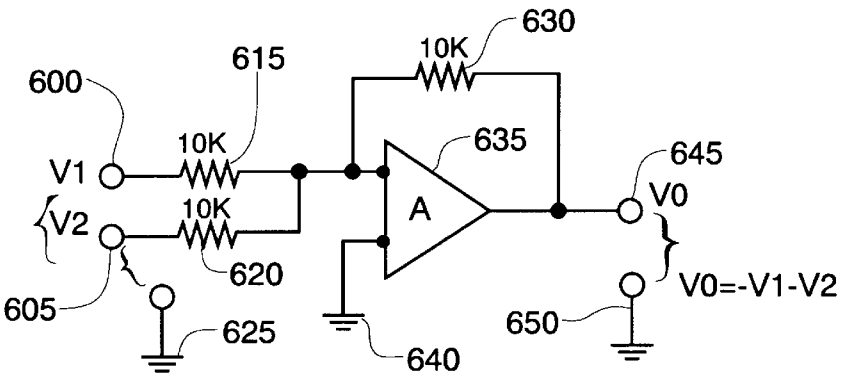
FIGS. 6*a* and 6*b* are diagrams showing operational amplifier circuitry of two elements of the estimator according to the present invention.
Figure 6B:
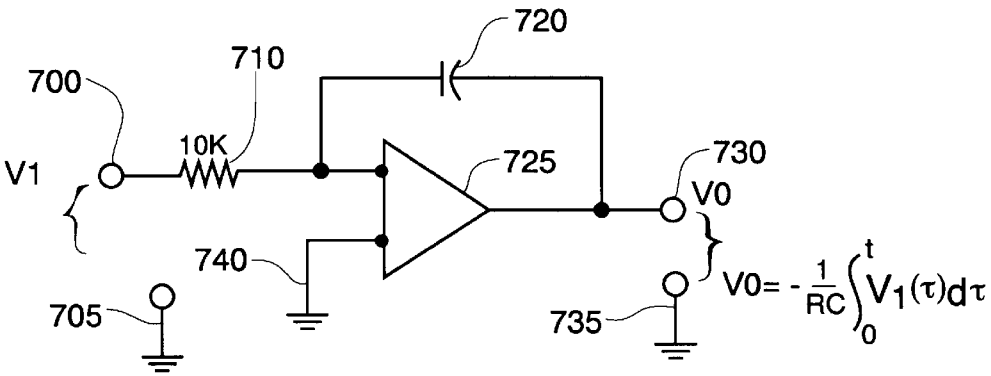

FIGS. 6*a* and 6*b* show the summer and integrator elements of the invention as shown in FIG. 5, respectively, using operational amplifier (OP AMP) circuits that are commercially available. FIG. 6*a* is an inverting adder operational amplifier. Any number of input signals 600 and 605 can be summed using this configuration and the ratio in which they are added is selected by the choice of the input resistors 615 and 620, nominally 10 k. The two input resistors 615 and 620 are shown in parallel being input through a single input into OP AMP 635. The resistors are all connected to the common or summing point of the circuit. The input resistors can have any values depending on the application of the present invention. FIG. 6*b* shows a inverting integrator operational amplifier circuit 725 which can be used for the integrators shown in FIG. 5. The OP AMPS 725 are employed as high gain isolation devices using the resistor 710 in series with the capacitor 720. Both of these circuits are well known in the art.

Detector Element

Before the detector element of the present invention is described, it is important to describe what happens to the human-machine system at the brink of instability in order for one skilled in the art to understand how to build the detector element. The key point is to discern between tracking behavior which is under control and tracking behavior which is either oscillatory or on the verge of divergence. This done primarily through the second method of analysis.

Analysis of a PIO and the Detection Algorithm

When a human-machine system is at the brink of instability, a pilot-induced oscillation (PIO) may occur. This problem was first noted by the Wright Brothers as it occurred in the pitch axis on the first aircraft. Since this time, on every new experimental aircraft under testing, some incidence of this behavior has been recorded. This event occurs primarily because test pilots, by the very nature of their mission, push new aircraft to their performance limits, thus precipitating this type of problem. In recent times, PIOs are known to occur without a pilot's recognition of the problem, resulting in crashes which could have been averted if a detector, as described in this application, could have alerted the pilot to this situation.

Figure 7:
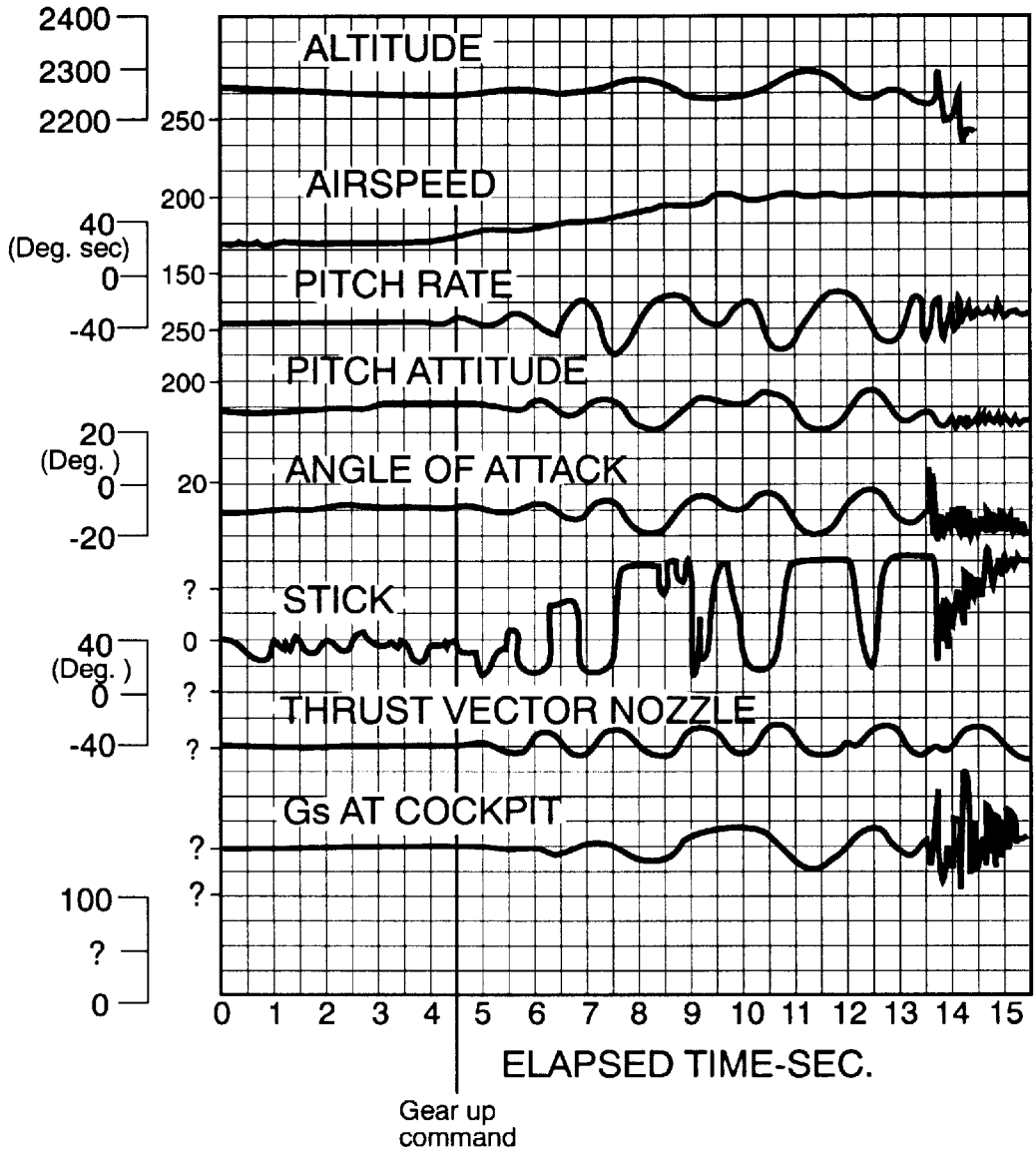
FIG. 7 illustrates data from a pitch axis indicating pilot induced oscillation (PIO) in experimental aircraft.

For example, FIG. 7 illustrates data from a pitch axis PIO in the experimental aircraft (YF-22) which crashed one of the two prototypes built costing the U.S. Air Force over one billion dollars. From this data, the closed-loop tracking error exhibits sinusoidal type behavior during a PIO with frequency of oscillation less than 1 Hz.

FIGS. 8*a*–8*c* illustrate a synthesized phase plane plot describing a sinusoidal e(t) signal (during a PIO) within the context of FIG. 1. To examine this problem in further detail, the assumption is made that the major component of the e(t) signal can be represented by the time function:

$$e(t)=A \sin \omega t \quad (19)$$

The derivatives of e(t) are then specified as follows:

$$(de/dt)=A\omega \cos \omega t \quad (20)$$

$$(d^2e/dt^2)=-A\omega^2 \sin \omega t \quad (21)$$

$$(d^3e/dt^3)=-A\omega^3 \cos \omega t \quad (22)$$

In FIGS. 8*a*–8*c*, the elliptical diagrams are illustrated which apply to equations (19)–(22). They are all similar in shape with an eccentricity (ratio of the minor to major axes) of $(1/\omega)$ and A being a constant. Time is parametric on the plots and with some effort, one can see that on a percentage basis, the number of data points that fall in quadrants I and III during a complete cycle will satisfy the rule (for all the FIGS. 8*a*–8*c*) that a percentage of points in Quadrants I and III at the incidence of a PIO is equal to 50%.

Thus according to the present invention, a decision rule or logic tree to detect whether or not tracking error instability is about to occur is based on the measurement of the following three metrics ($r_1$, $r_2$, and $r_3$), which are derived from the percentage points in any one quadrant:

To derive these metrics, let $r_1$ be defined as the percentage of points in Quadrants I and III in FIG. 8*a* (the (de/dt) versus e phase plane; let $r_2$ be defined as the percentage of points in Quadrants I and III in FIG. 8*b* (the $(d^2e/dt^2)$ versus (de/dt) phase; and let $r_3$ be defined as the percentage of points in Quadrants I and III in FIG. 8*c* (the $(d^3e/dt^3)$ versus $(d^2e/dt^2)$ phase plane).

Clearly at a PIO condition (and for a perfect error sine wave), $r_1$=0.5, $r_2$=0.5, and $r_3$=0.5. At an instability, it is easy to show that $r_1$>0.5, $r_2$>0.5, and $r_3$>0.5. As an example of a detection scheme, the present invention anticipates the following methodology:

(M–1)(1) Check if either $r_1$>0.5, or $r_2$>0.5, or $r_3$>0.5. (23)

(M–2)(2) If (M–1) is true, then check if $r_1 r_2$>0.25, $r_1 r_3$>0.25, or $r_2 r_3$>0.25. (24)

(M–3)(3) If (M–2) is true then check if $r_1 r_2 r_3$>0.125. (25)

For a conservative detector, the rule could be that if (M–3) is satisfied, a red light indicator would go on to warn the pilot of a potential instability. If the data were more noisy and a less conservative scheme was desired, the detection rule could be to turn on the red light if (M–2) or (M–3) were true. For a more liberal design, the detector would turn on the red light if either (M–1), or (M–2) or (M–3) were to be satisfied.

Figure 9:
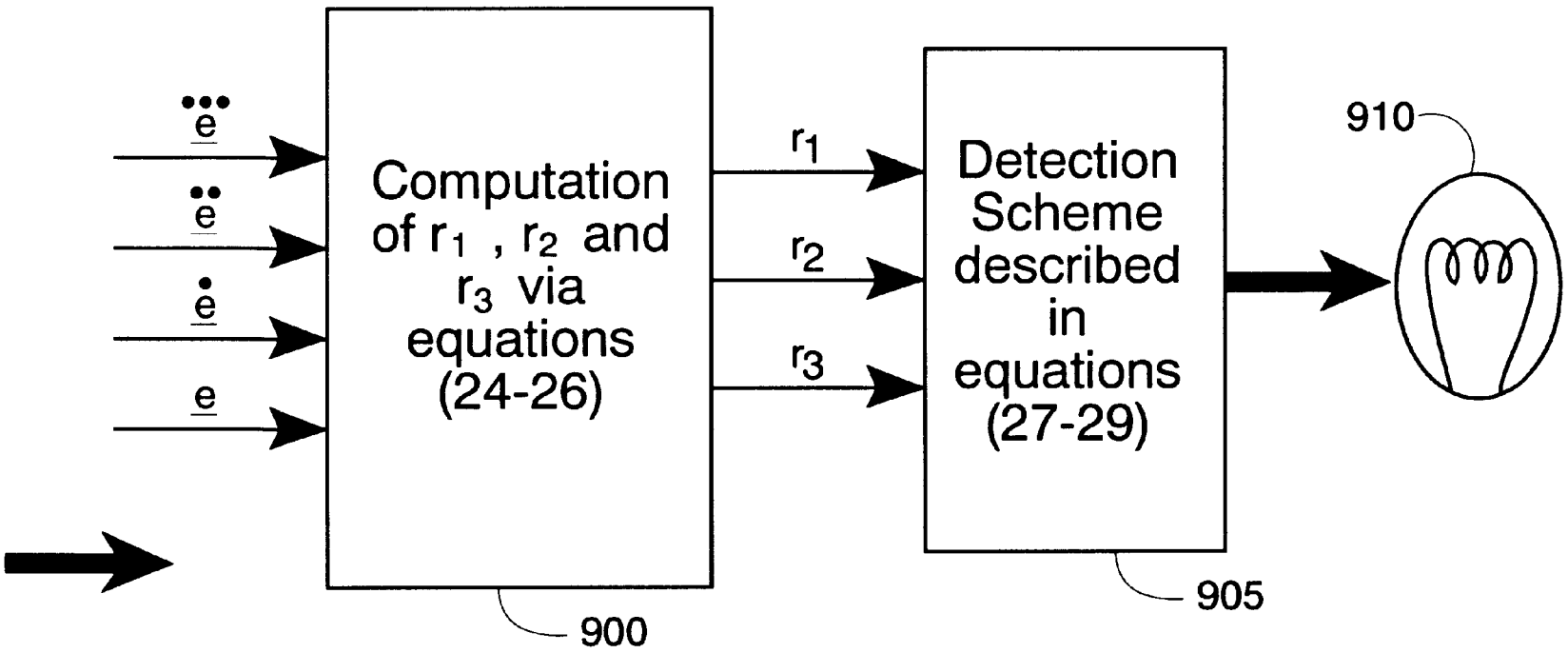
FIG. 9 illustrates the detector according to the present invention.

FIG. 9 illustrates the present invention including the generic detector system as described above. Those skilled in the art will readily appreciate that this detector system can be made in any number of ways using existing commercial devices and/or software. As shown, the four outputs of the estimator shown in FIG. 5 are input into a computer or processor 900 in order to compute the values of $r_1$, $r_2$, and $r_3$. These values are then input into another computer or processor 905 or referred through the computer or processor 900 to analyze the conditions as set forth above. Depending on whether there is an error in tracking and depending on the logic tree selected, an indicator, such as light, alarm, or similar means, would activate or not.

Experimental Data

To provide those skilled in the art with a validation of the present invention, data from an experiment will be described. Data was collected to validate the present invention. Using the system described in FIG. 1, a time delay was added to the stick output of the operator. This delay affected the response time between a command on the joystick and its effect in the change of the response of the tracking aircraft ($f_p$ in FIG. 1). The experimental paradigm, involving human tracking, consisted of increasing the time delay until the overall human-machine system went into oscillation. It is noted that roll and pitch noise were also added to the simulation to help trigger a PIO. Studies in human-machine systems have demonstrated that for a sufficiently long time delay, human tracking behavior changes from a continuous form of movement to discrete (wait and see) movements. When the time delay gets sufficiently large (with turbulence noise added in both the pitch and roll axis), the overall system goes into oscillations, or there is a complete loss of tracking control. This is a well-known effect documented in the aeronautical literature of the occurrence of phenomena of this type.

Figure 10:
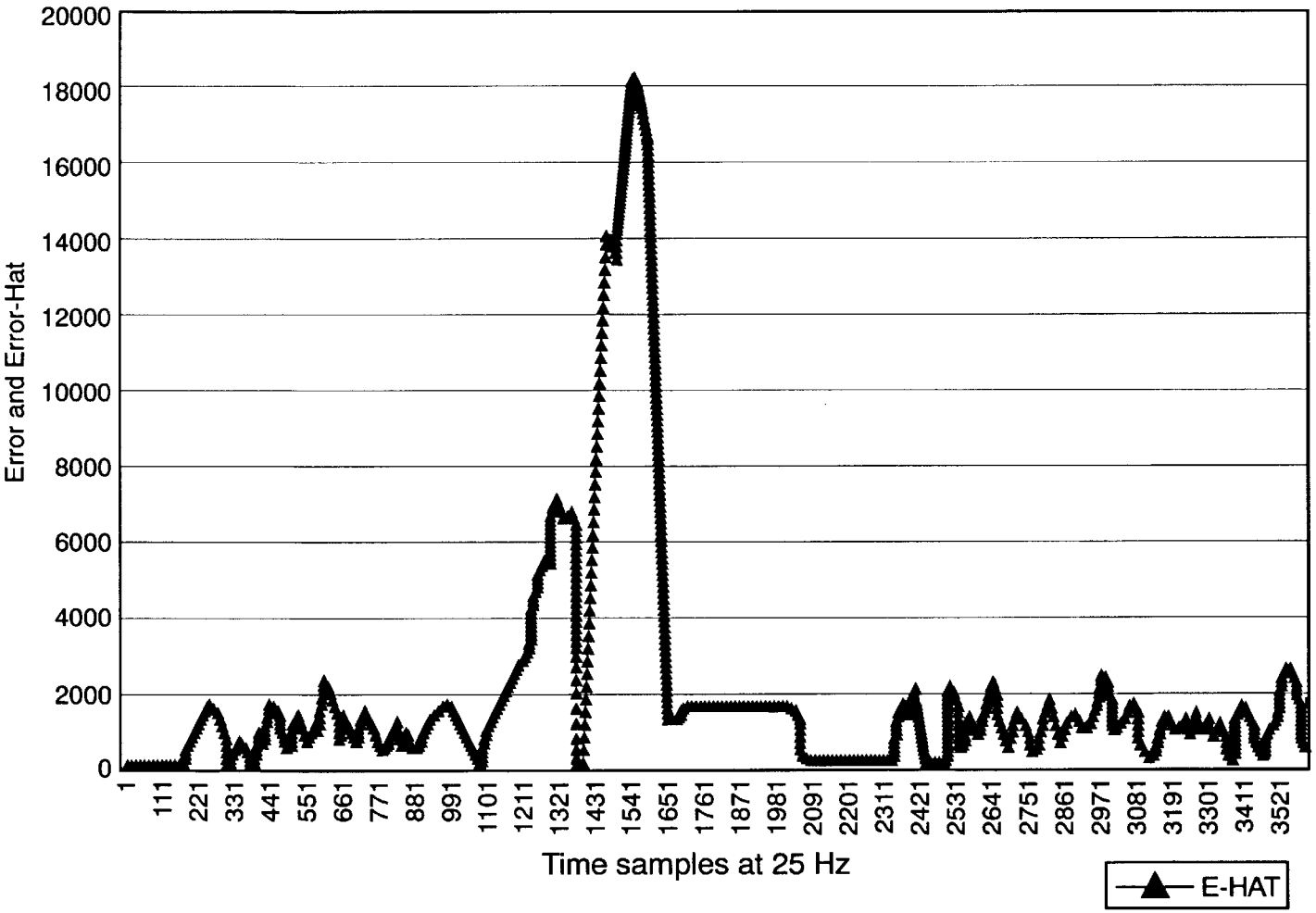
FIG. 10 illustrates the closed-loop tracking error of an operator in a controllable situation (very low time delay)
Figure 11:
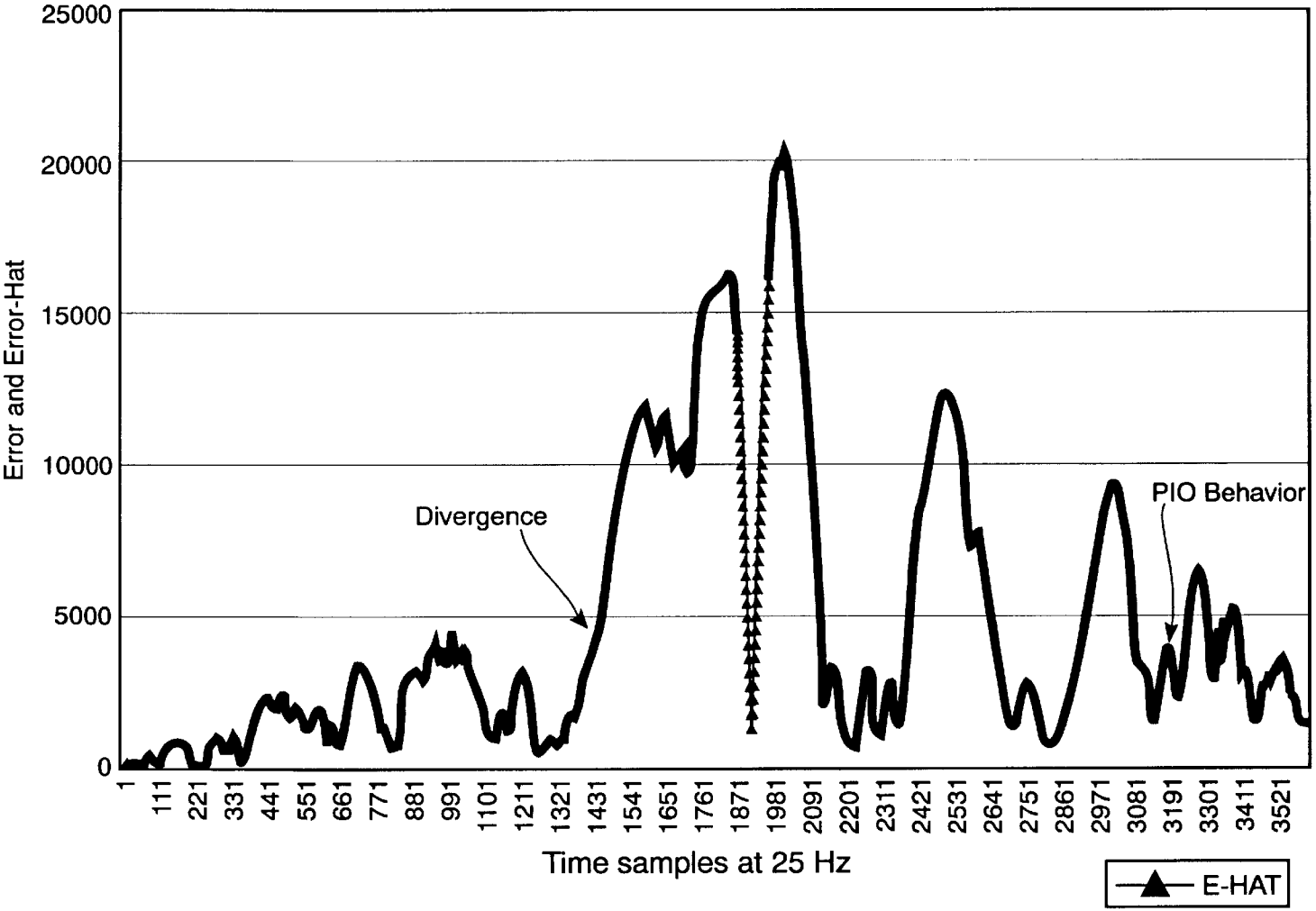
FIG. 11 illustrates the closed-loop tracking error of an operator during uncontrollable oscillations or divergent behavior (precipitated by a 600 millisecond time delay and with turbulence noise added to the closed-loop simulation)
Figure 12A:
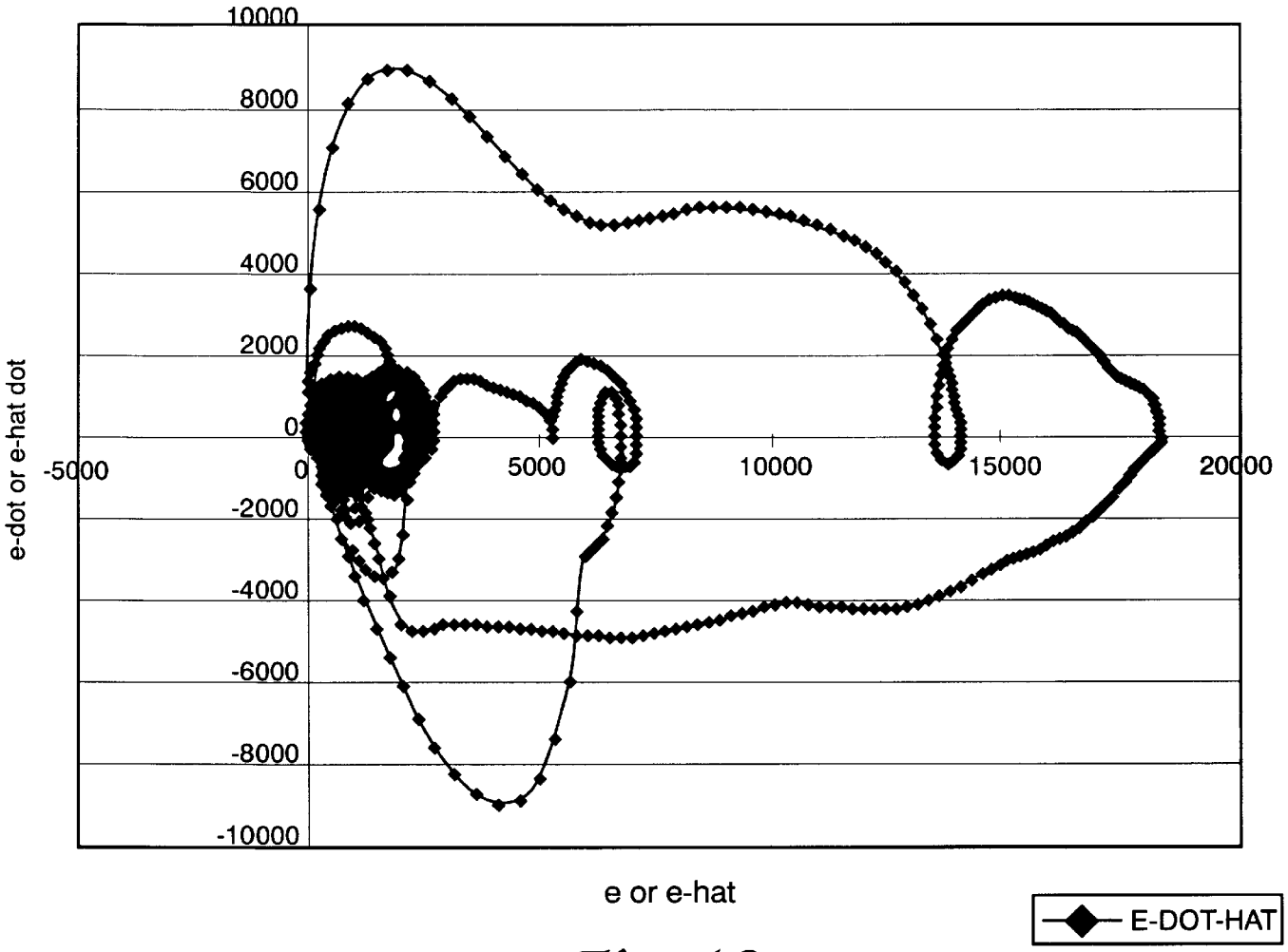
FIGS. 12*a*, 12*b*, and 12*c* are the three phase planes of interest for a stable tracking situation.
Figure 12B:
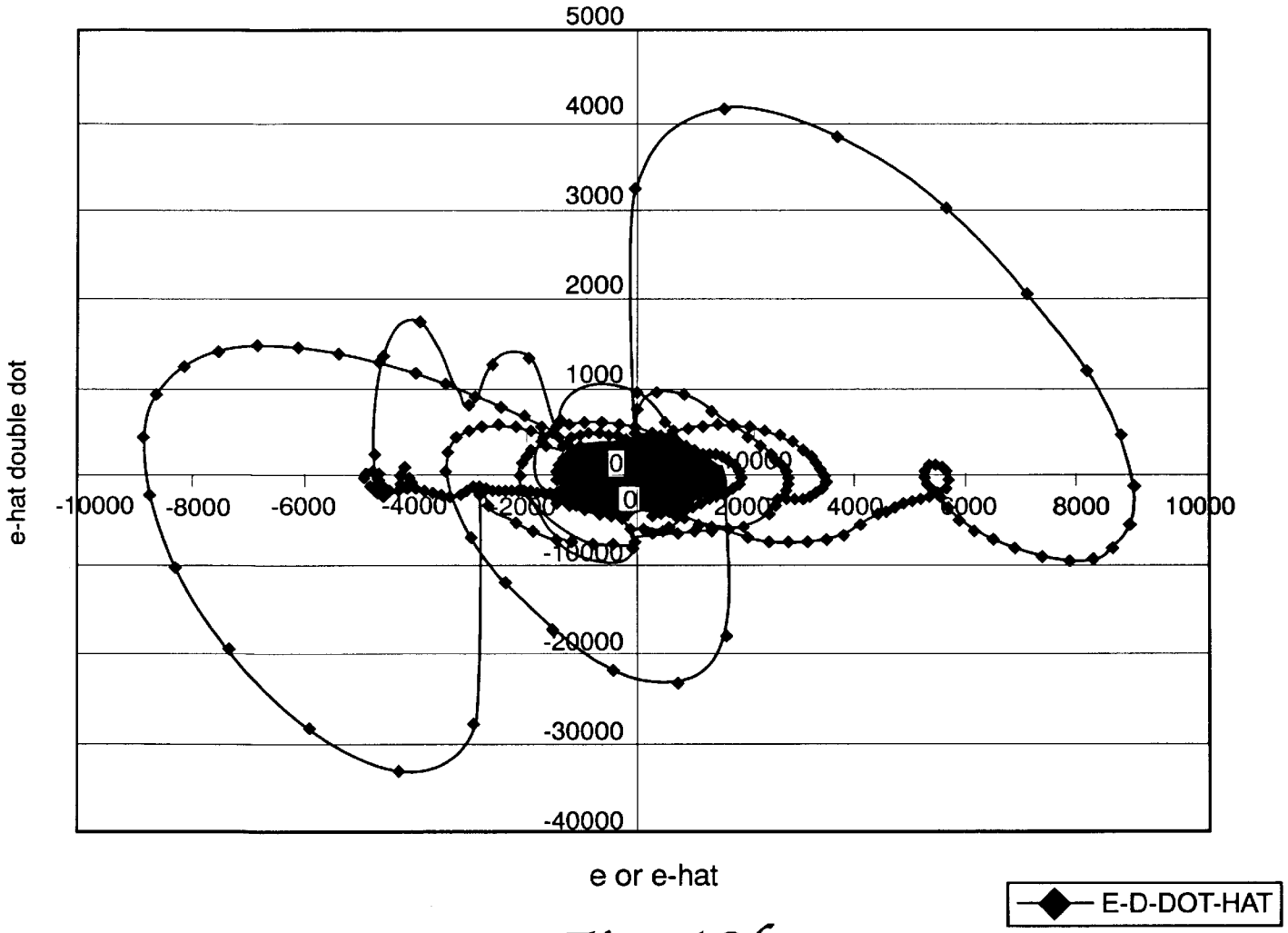
Figure 12C:
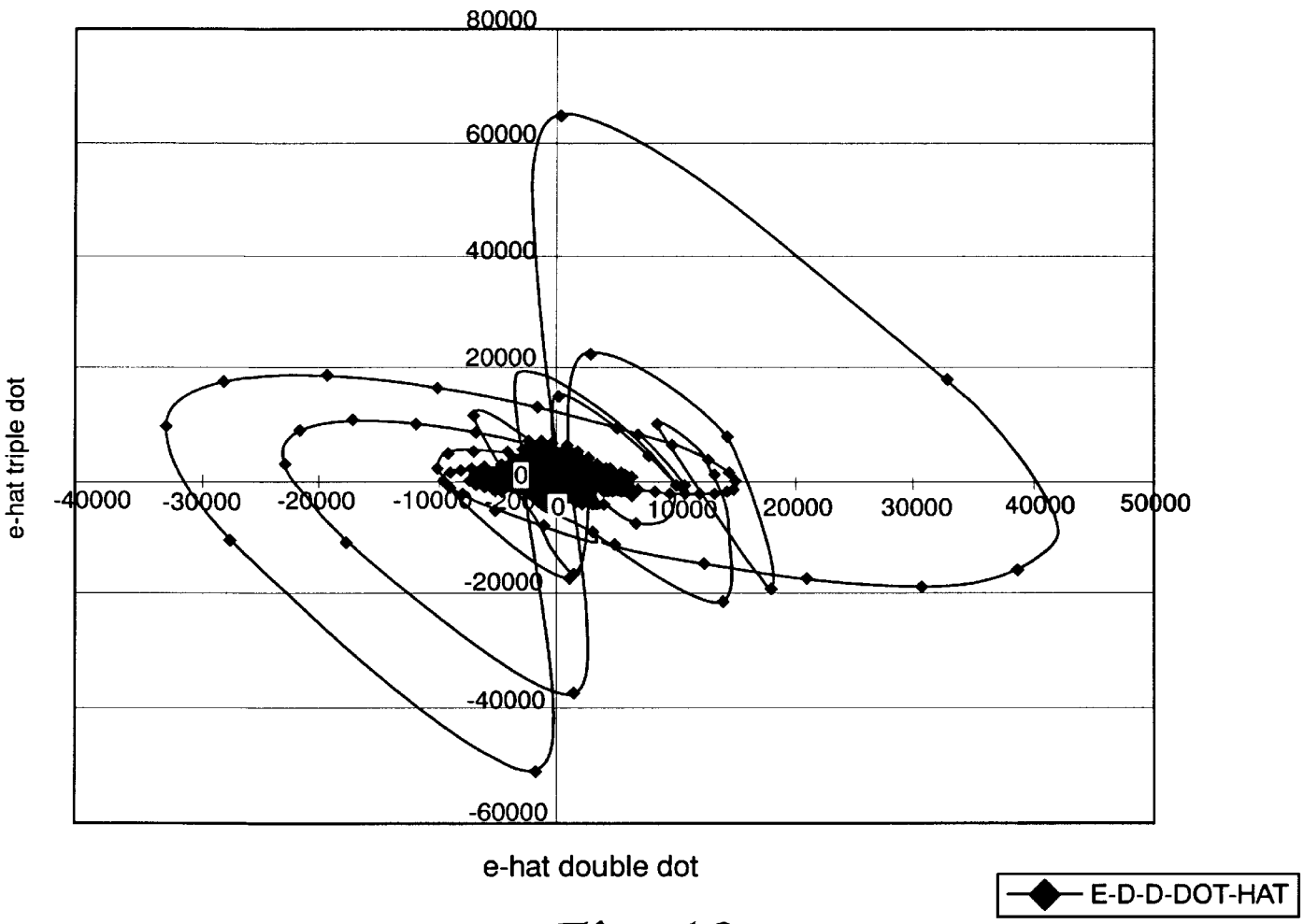
Figure 13A:
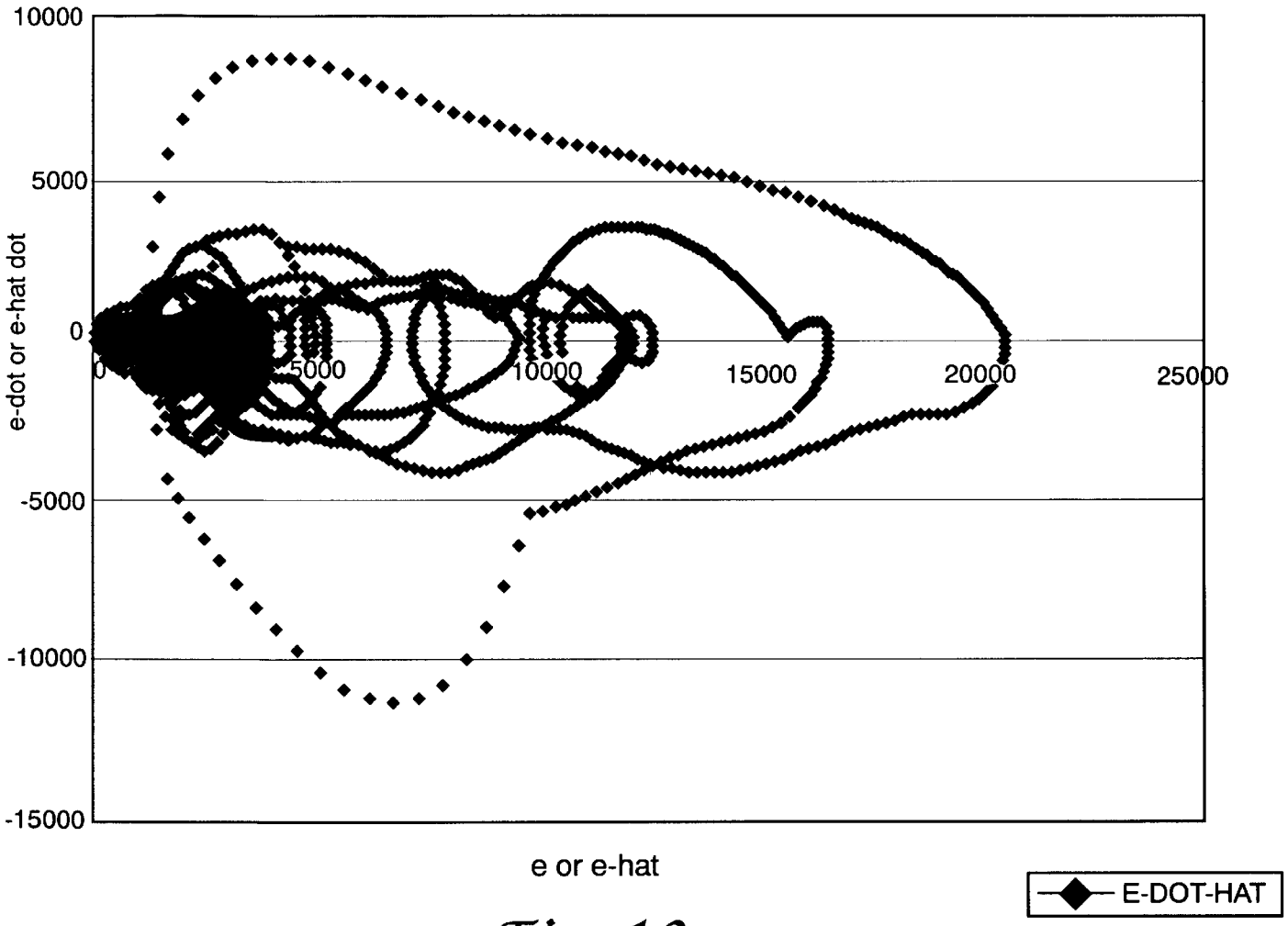
FIGS. 13*a*, 13*b*, and 13*c* are the same phase plane plots as in FIGS. 12*a*–12*c* for an unstable tracking situation.
Figure 13B:
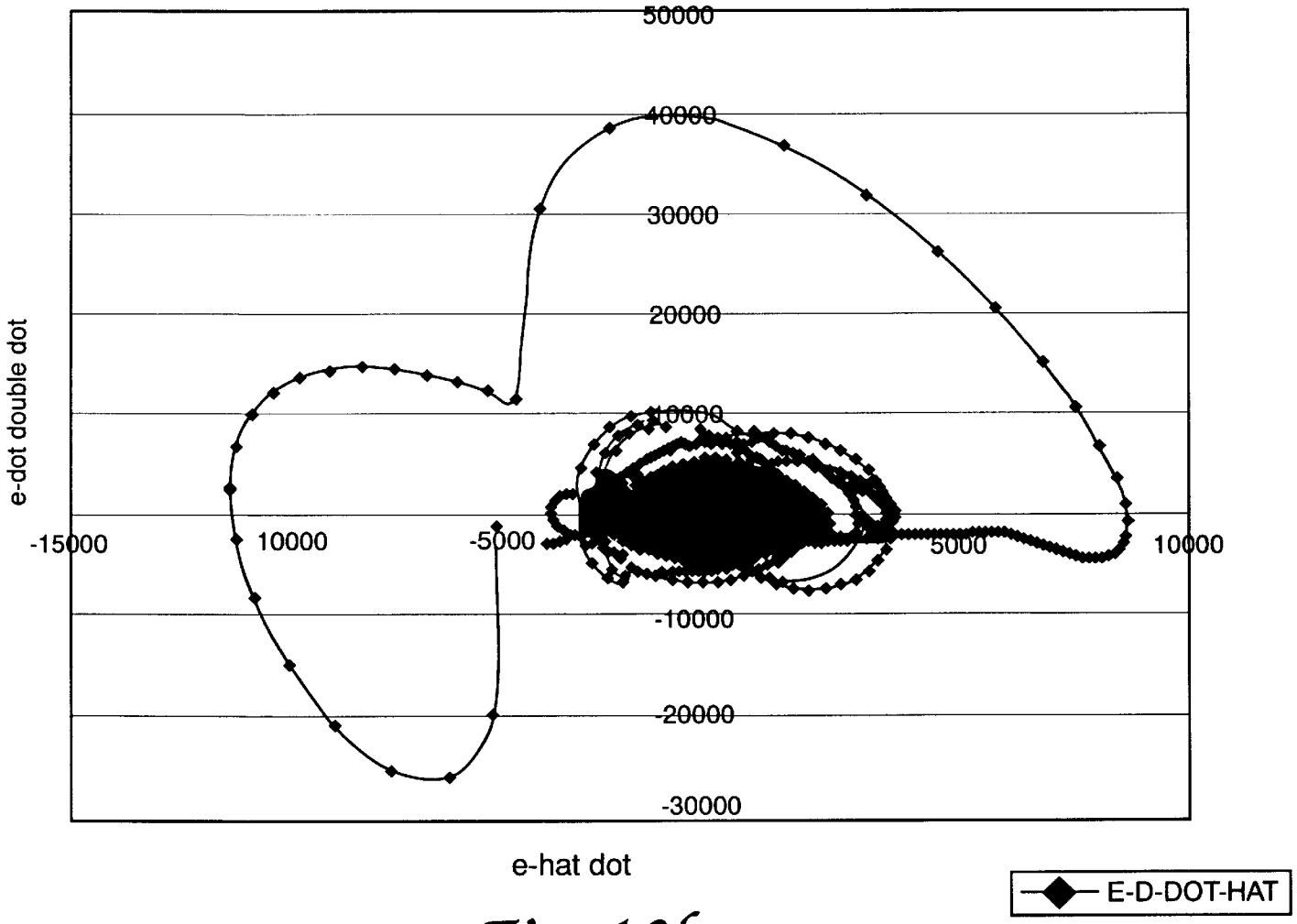
Figure 13C:
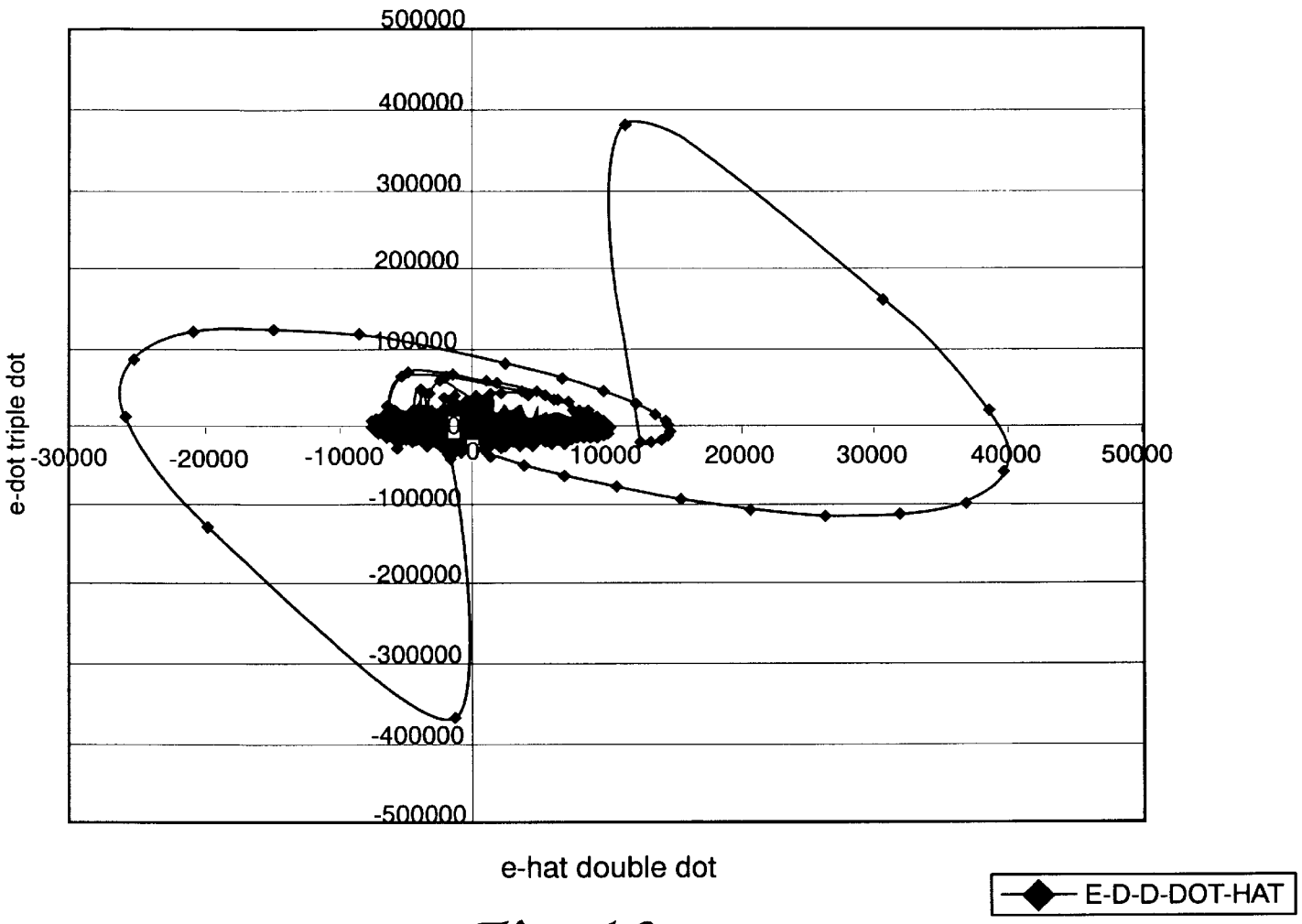

FIG. 10 illustrates the closed-loop tracking error of an operator in a controllable situation (very low time delay) and FIG. 11 illustrates this same subject during uncontrollable oscillations or divergent behavior (precipitated by a 600 millisecond time delay and with turbulence noise added to the closed-loop simulation). FIGS. 12*a*–12*c* are the three phase planes of interest for the stable tracking situation and FIGS. 13*a*–13*c* are these same phase plane plots for the unstable tracking situation. It is useful to compare the scales of the respective axes, as well as the trajectory shapes, when discerning differences between FIGS. 12*a*–12*c* and 13*a*–13*c*. Table I compares the $r_1$, $r_2$, and $r_3$ values with their respective product terms for controllable tracking versus uncontrollable tracking. As those skilled in the art will appreciate, comparisons between these values in Table I to the phase plane plots of FIGS. 12*a*–12*c* and 13*a*–13*c* are revealing.

TABLE I $r_1$, $r_2$, and $r_3$ Values for Stable and Unstable Tracking Behavior

| Tracking Mode | $r_1$ | $r_2$ | $r_3$ | $r_1 r_2$ | $r_2 r_3$ | $r_1 r_3$ | $r_1 r_2 r_3$ |
|---|---|---|---|---|---|---|---|
| Stable Tracking | 0.429 | 0.117 | 0.145 | 0.050 | 0.017 | 0.062 | 0.007 |
| Unstable Tracking | 0.754 | 0.226 | 0.251 | 0.170 | 0.056 | 0.189 | 0.043 |

Comparison of the respective quantities ($r_1$, $r_2$, and $r_3$) as described in equations (24)–(26) indicate a relative concurrence between the decision rules as explained in (27)–(29) with the data portrayed in Table I with values about one-half those theoretically predicted for a PIO. Comparing between rows 1 and 2 of Table I, however, makes it possible to distinguish between the two types of tracking behavior. The term $r_1 r_2 r_3$ shows the greatest relative method of distinguishing between these two modes of tracking behavior as manifested by these metrics.

Finally, as a caveat to this approach, it is noted than any decision mechanism is prone to false positives and missed negatives (type I and II error). The level of conservativeness of the detector can be varied (via the choice of rules in equations (27)–(29)) such that an adjustment can be made by the operator on his need to be alerted to the possible loss of tracking control. Obviously, increasing the sensitivity to potential instability would lead to more incidents of false positives and vice versa.

Also the presumption that Euler's method could be used to characterize the closed-loop error of the human-machine system as a first order system may be questioned. This assumption is equivalent to the transfer function in FIG. 1 to be approximated by:

$$H(s)=f_p/e\approx\omega_c/s \tag{30}$$

where s is the Laplace transform variable, and $\omega_c$ is a constant. There is strong evidence in the literature that 90% of the signal strength of human-machine interaction is characterized in this manner. This is termed the "crossover" model and to a first order approximation, this is the most widely accepted model of human performance in the literature today.

Although the present invention has been described with regard to one embodiment, those skilled in the art will readily recognize that other variations on the design of the present invention exist. Accordingly, the inventors do not wish to be limited by the present specification, but only by the appended claims.

Moreover, the present invention has been primarily described in terms as having a primary application as device and method to detect tracking errors, however, the present invention would be useful in a myriad of other applications.

What is claimed is:

1. A method for detecting potential loss of tracking control between a tracker unit and a target trajectory comprising the steps of:

calculating a tracking error from a position indicator means, the tracking error being the difference between the target trajectory and a desired response of the tracker unit;

estimating the tracking error and derivatives of the tracking error in a phase plane; and detecting whether the tracking error is divergent.

2. The method of claim 1 wherein the difference between the target trajectory and the desired response of the tracker unit is calculated from information provided by a system selected from the group consisting of Global Positioning System (GPS), radar, Airborne Warning and Control System (AWACS), data link, video source, landing approach aid, specified flight path trajectory, or a satellite.

3. The method of claim 1 further comprising the step of alerting an operator of the tracker unit when the tracking error is divergent.

4. The method of claim 3 further comprising the steps of:

calculating percentage points when the tracking error and its derivatives are in selected portions of the phase plane;

calculating whether the percentage points in selected portions of the phase plane exceed a predetermined threshold indicating loss of tracking control; and detecting when the predetermined threshold is exceeded.

5. The method of claim 4 wherein a logic tree is used to detect when the predetermined threshold is exceeded.

6. The method of claim 1 wherein calculating whether the tracking error is divergent is determined when a trajectory of the tracking error is in either of two quadrants of a four-quadrant phase plane.

7. The method of claim 6 wherein the trajectory is calculated to be divergent if one of the following conditions are met: the trajectory is in a wholly positive quadrant of the phase plane, independent and dependent variables are in both positive or negative quadrants of the phase plane, and independent and dependent variables are both negative.

8. The method of claim 1 wherein the estimation of the tracking error and its derivatives of said estimating step is done by calculating state variables for the tracking error and its derivatives by filtering the tracking error and its derivatives through a low-pass filter.

9. An apparatus for detecting potential loss of tracking control between a tracker unit and a target comprising:

means for calculating a tracking error from a position indicator means, the tracking error being the difference between the target and a desired response of the tracker unit;

means for estimating the tracking error and derivatives of the tracking error in a phase plane; and means for detecting whether the tracking error is divergent.

10. The apparatus of claim 9 wherein the means for calculating the difference between the target and the desired response of the tracker unit receives input data from a system selected from the group consisting of Global Positioning System (GPS), radar, Airborne Warning and Control System (AWACS), data link, video source, landing approach aid, specified flight path trajectory, or a satellite.

11. The apparatus of claim 9 further comprising means for alerting an operator of the tracker unit when the tracking error is divergent.

12. The apparatus of claim 11 further comprising:

means for calculating percentage points when the tracking error and its derivatives are in selected portions of the phase plane;

means for calculating whether the percentage points in selected portions of the phase plane exceed a predetermined threshold indicating loss of tracking control; and means for detecting when the predetermined threshold is exceeded.

13. The apparatus of claim 12 wherein the means for detecting when the predetermined threshold is exceeded is a processor programmed with a logic tree.

14. The apparatus of claim 9 wherein the means for calculating whether the tracking error is divergent includes means for determining when a trajectory of the tracking error is in either of two quadrants of a four-quadrant phase plane.

15. The apparatus of claim 14 wherein the means for determining when the trajectory of the tracking error is in either of two quadrants of a four-quadrant phase plane includes means for determining if one of the following conditions are met: the trajectory is in a wholly positive quadrant of the phase plane, independent and dependent variables are in both positive or negative quadrants of the phase plane, and independent and dependent variables are both negative.

16. The apparatus of claim 9 wherein the means for estimating the tracking error and its derivatives includes means for calculating state variables for the tracking error and its derivatives by low pass filtering means.

17. The apparatus of claim 9 wherein the means for estimating the tracking error and its derivatives includes a summer and at least one integrator connected in series through a feedback circuit.

18. The apparatus of claim 17 wherein the summer is an inverting, adder operational amplifier circuit and said integrator is an inverting integrator operational amplifier circuit.

19. The apparatus of claim 18 further comprising an alarm means which is activated when the means for detecting whether the tracking error is divergent detects that the tracking error is divergent.

* * * * *